US005688034A

United States Patent [19]

Kojima

[11] Patent Number: 5,688,034

[45] Date of Patent: Nov. 18, 1997

[54] REFRIGERATOR SHOW-CASE DISPLAY STAND

[75] Inventor: Noboru Kojima, Aichi-ken, Japan

[73] Assignee: Kabushiki Kaisha Yunikura Sangyo, Aichi-ken, Japan

[21] Appl. No.: 625,244

[22] Filed: Apr. 1, 1996

[30] Foreign Application Priority Data

Jan. 8, 1996 [JP] Japan ..... 8-000284

[51] Int. Cl.[6] ..... A47B 57/00

[52] U.S. Cl. ..... 312/408; 312/351; 312/128; 211/181; 211/175

[58] Field of Search ..... 312/351, 126, 312/128, 136, 404, 408, 410; 108/129; 211/181, 175

[56] References Cited

U.S. PATENT DOCUMENTS

| | | | |
|---|---|---|---|
| 1,663,609 | 3/1928 | Peabody | 108/129 X |
| 1,834,488 | 12/1931 | Gilbert | 108/129 |
| 3,003,248 | 10/1961 | Wittie | 211/181 X |
| 3,052,508 | 9/1962 | Fink | 312/404 |
| 3,385,452 | 5/1968 | Dantino et al. | 211/175 |
| 3,385,453 | 5/1968 | Dantino et al. | 211/175 |
| 3,586,411 | 6/1971 | Brigham | 312/128 X |
| 4,077,522 | 3/1978 | Trubiano | 211/175 |
| 4,404,915 | 9/1983 | Simpson | 108/43 |
| 4,930,642 | 6/1990 | Brooks et al. | 211/181 X |
| 4,991,908 | 2/1991 | Krechel | 108/43 X |
| 5,314,080 | 5/1994 | Wentworth | 211/181 |

FOREIGN PATENT DOCUMENTS

| | | |
|---|---|---|
| A-10923/92 | 2/1992 | Australia . |
| 225144 | 6/1994 | Japan . |

*Primary Examiner*—Jose V. Chen
*Assistant Examiner*—Janet M. Wilkens
*Attorney, Agent, or Firm*—Graybeal Jackson Haley LLP

[57] ABSTRACT

In combination with an upwardly open, rectangular refrigerator repository, a display stand in the form of a loading plate in the repository with approximately the same width dimension as the repository and with a pair of legs attached to and pivotally movable with respect to the edge portions defining the width dimension of the loaded plate. The pair of legs engage the bottom of the repository in different attitudes to arrange the loading plate at various positions in the repository.

4 Claims, 5 Drawing Sheets

REFRIGERATOR SHOW-CASE DISPLAY STAND

[BACKGROUND OF THE INVENTION]

1. [Field of the Invention]

This invention relates to a display stand to be disposed in a storage or repository of a refrigerator show-case having a rectangular cross sectional shape and to be upwardly open.

2. Description of the Prior Art

To store and/or display articles such as frozen food or food requiring refrigeration, a use is made of a refrigerator show-case including a repository having a rectangular cross sectional shape and to be upwardly open.

It is sometimes difficult to see articles housed in the repository or to take them out, depending on the depth of the repository of the refrigerator show-case, that is, the height dimension of the wall of the repository, or the sizes, the quantity or the like of the articles housed in the repository.

An object of the present invention is to provide a display stand for arranging articles so as to be readily seen in the repository of the refrigerator show-case.

Another object of the present invention is to provide a display stand for arranging articles so as to be readily taken out in the repository of the refrigerator show-case.

[SUMMARY OF THE INVENTION]

The display stand of the present invention is applied to a refrigerator show-case provided with a repository having a rectangular cross sectional shape and open at the upper part. The display stand comprises a loading plate and a pair of legs for supporting the plate. The loading plate has a width dimension approximately equal to the distance between a pair of opposing wall surfaces of the repository. Also, both legs are respectively attached to the loading plate so as to swing around both axes parallel to both edge portions defining the width dimension of the plate, the legs having different height dimensions.

The loading plate consists of, for example, a rectangular first frame and a plurality of rod members disposed at intervals on the first frame, each leg consisting of a rectangular second frame. Each second frame is attached to the first frame through a plurality of sleeves fixed to the first frame, and part of each second frame extends through the sleeves. The display stand can be applied to a repository having a bottom provided with a plurality of grooves spaced apart from each other so as to receive part of each leg of the display stand.

The present invention further comprises distance holding means for holding the distance between both legs. The distance holding means includes, for example, a plate member extending between a pair of wall surfaces of the repository, and a pair of pieces which are inserted into one of a plurality of holes provided at intervals on the plate member in the direction of extension so that both legs can be engaged therewith. Also, the holding means may be, for example, a spacer disposed between both legs.

According to the present invention, since the height dimensions of both legs swingably attached to the loading plate are made different, the loading plate is in an inclined state when both legs stand vertically. Also, since the loading plate has a width dimension approximately equal to the distance between the pair of opposing wall surfaces of the repository of the refrigerator show-case, the loading plate is restricted between both wall surfaces of the repository when the display stand of the present invention is disposed in the repository, so that the loading plate cannot substantially make any swinging motion relative to each leg. Therefore, both legs are kept vertical, so that the loading plate is kept inclined. Consequently, articles such as frozen food and food requiring refrigeration can be placed onto an inclined surface in the upper portion from the bottom of the repository, and thereby, the articles can be displayed in the repository so as to be readily seen or taken out.

Further, since each leg is swingable around axes parallel to the edge portions defining the width dimension of the loading plate, the angle of inclination or the height position of the loading plate can be varied. The non-vertical standing state of the legs can be maintained by disposing the legs in any of the grooves on the bottom of the repository, or by holding the distance between both legs by the distance holding means. The best display surface according to the sizes, quantity or the like of the articles can be selected.

A use of the distance holding means is suitable particularly where the bottom of a repository of a refrigerator show-case has no grooves as described above.

Where the distance holding means are composed of the plate member having a plurality of holes and a pair of pieces which are inserted in a pair of holes of the plate member so that both legs can be engaged with the pieces, the distance between both legs engaged with both pieces can be changed by changing holes for inserting the pieces, and the angle of both legs relative to the loading plate can be changed. Also, in case the distance holding means is composed of a spacer, the distance between both legs can be changed by preparing spacers having various length dimensions.

[DETAILED DESCRIPTION OF PREFERRED EMBODIMENTS]

Figure 1:
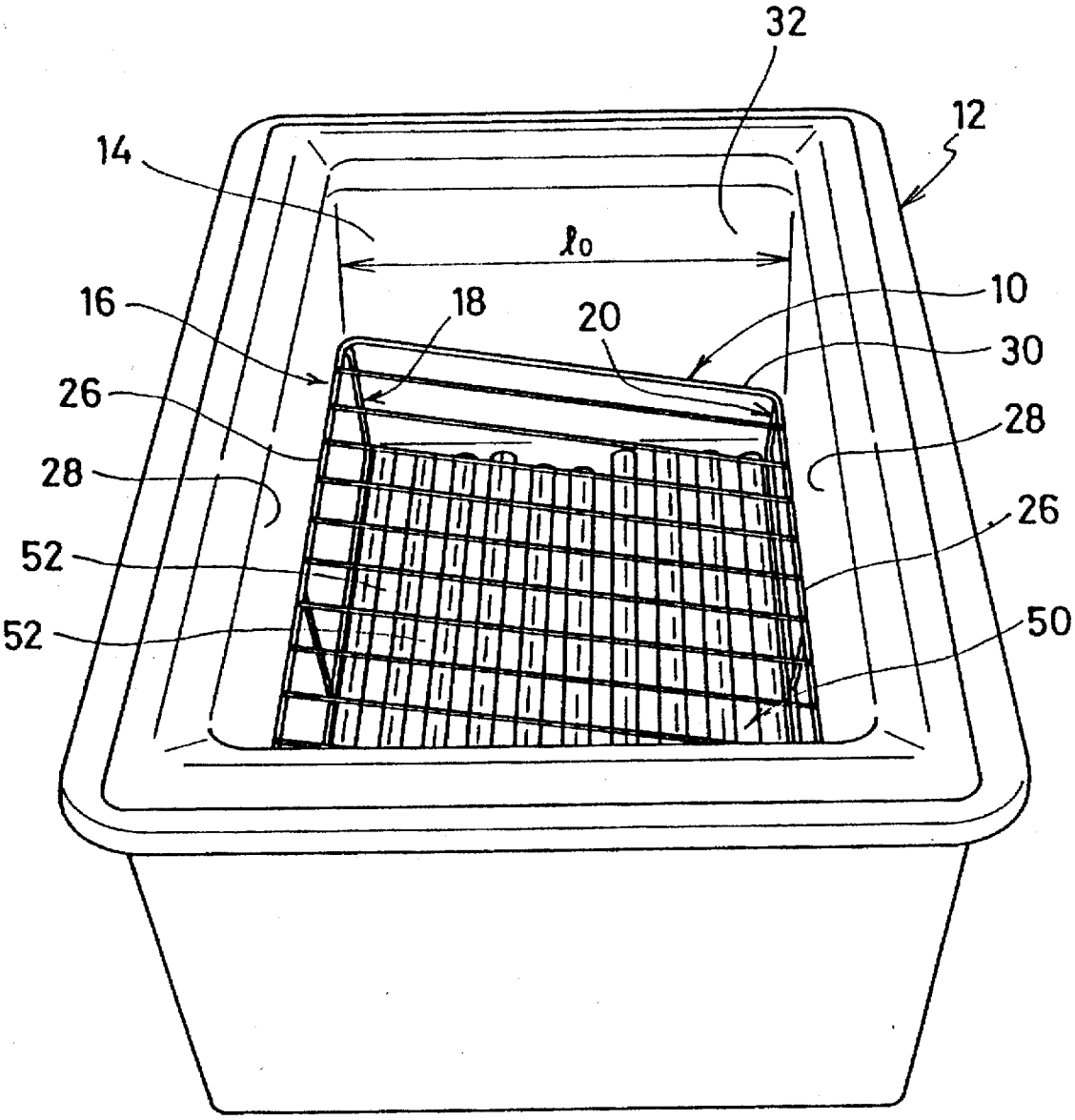
FIG. 1 is a perspective view of the display stand of the present invention applied to a refrigerator show-case provided with a repository having a plurality of grooves.

Referring to FIG. 1, a display stand 10 for displaying articles such as frozen food or food requiring refrigeration is disposed inside a storage or repository 14 of a refrigerator show-case 12.

The repository 14 has a rectangular cross sectional shape and is upwardly open. The inside of the repository 14 is maintained at a low temperature by actuation of a refrigerator unit (not shown) disposed inside the refrigerator show-case 12, for preserving the frozen food or food requiring refrigeration.

Figure 2:
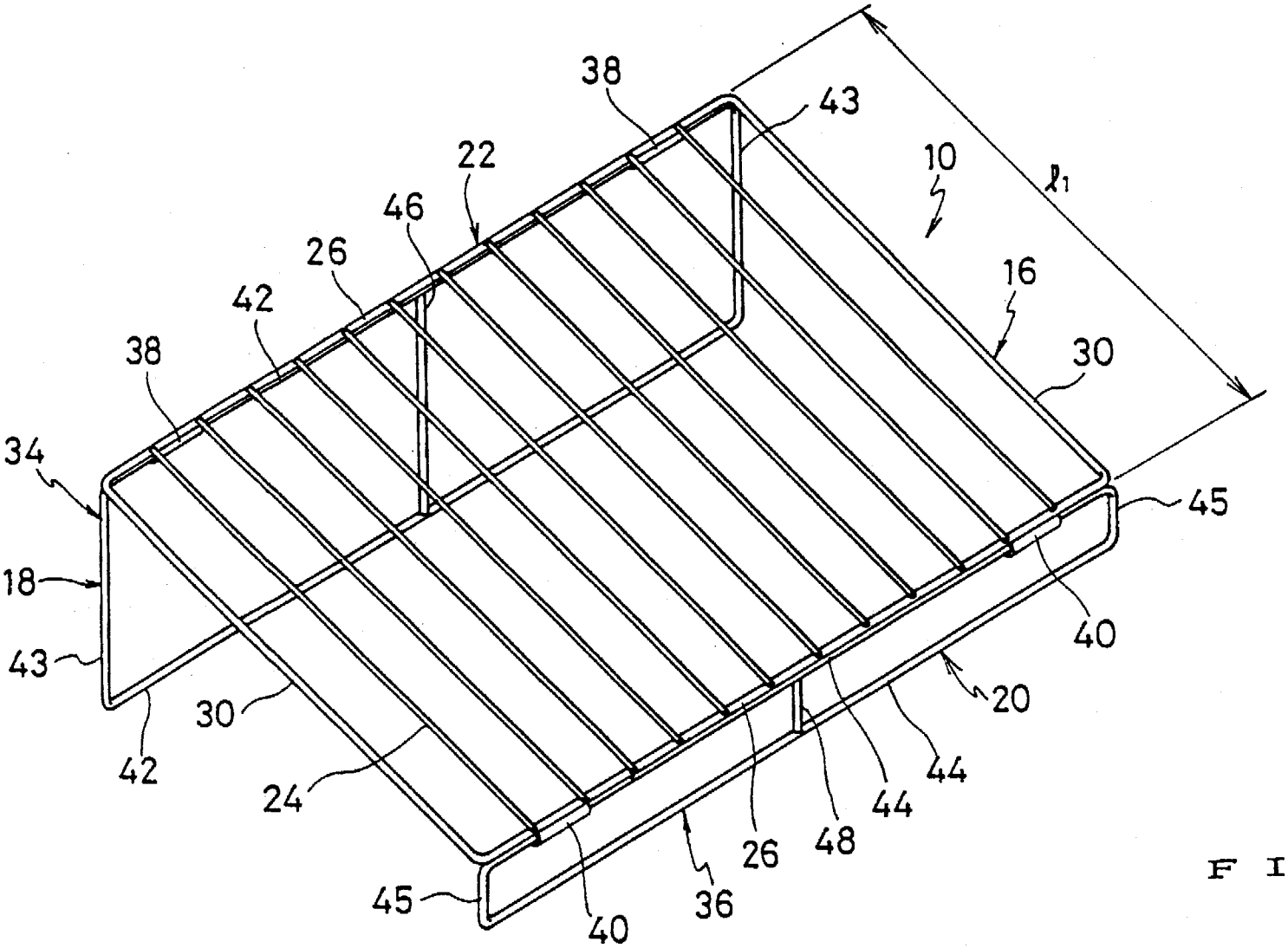
FIG. 2 is a perspective view of the display stand of the present invention.

As shown in FIG. 2, the display stand 10 comprises a loading plate 16 on which the articles are placed, and a pair of legs 18, 20 for supporting the loading plate 16.

The loading plate 16 shown includes a frame 22 (first frame) formed from a metal round bar bent in a rectangular shape, and a plurality of rod members composed of metal round bars fixed to the frame 22.

The frame 22 has a width dimension slightly smaller than the distance $1_0$ between the opposing pair of wall surfaces 28 (FIG. 1) of the repository 14, i.e., a width dimension $1_1$ approximately equal to the distance between both wall surfaces 28. Therefore, the loading plate 16 can be disposed inside the repository 14 in a horizontal state or in an inclined state. The loading plate 16 at this time is restricted by the opposing wall surfaces 28 of the repository relative to the cross direction of the loading plate 16.

The length dimension of the frame 22 relative to the direction of extension of both parallel portions 26 is approximately equal to the distance between the other opposing wall surfaces 32 of the repository 14 as shown, or can be a shorter length dimension than it.

The rod members 24 are disposed at intervals on the pair of opposing parallel portions 26 of the frame 22 in the direction of extension of the parallel portions, and welded at their end portions to both parallel portions 26. The rod members 24 spaced apart from each other permit placing of the articles thereon and moving of the cool air within the repository 14.

The frame 22 and the rod members 24 are respectively formed of plastic materials, wood or the like, in place of metal materials. Also, the loading plate 16 can be made of a metal plate, a plastic plate, a wooden plate with or without a plurality of holes, or a metal or plastic net.

Both legs 18, 20 for supporting the loading plate 16 are respectively constituted from frames (second frames) 34, 36 formed by metallic round bars bent into a rectangular shape and are swingably attached to the first frame 22 through a plurality of (two in the drawing) sleeves 38, 40.

Each of the second frames 34, 36 has a pair of opposing parallel portions 42, 44 having the same length as the parallel portions 26 of the first frame 22. Also, both other parallel portions 43 of one of the second frames 34 have a length dimension, i.e., height dimension greater than both other parallel portions 45 of the other second frame 36. Each of the second frames 34, 36 is reinforced by rod-shaped reinforcing members 46, 48 disposed between both parallel portions 42 and 44. Each of the legs 18, 20 can be formed by the same material as the plate 16.

The sleeves 38, 40 are respectively disposed at intervals in the lower part of each parallel portion 26 and fixed at each parallel portion 26, with their axes extending parallel to the axis of each parallel portion 26. One of both parallel portions 44 of the second frames 36 extends through each sleeve 40. Because of this, both second frames 34, 36 (both legs) can swing about both axes parallel to both edge portions (both parallel portions 26 of the first frame) defining the width dimension of the loading plate 16.

The height dimension of both legs 18, 20 can be freely set according to the sizes or the quantity of the articles to be displayed on the loading plate 16. The height dimension, however, is smaller than the depth of the repository 14, i.e., the height dimension of its wall surfaces 28. Also, the second frames 34, 36 can be attached to the rod members 24 or the other parallel portion 30 of the first frame 22 through sleeves. The length dimension of the parallel portions 42, 44 of each second frame may be smaller than the length of the parallel portions 26 of the first frame.

Referring again to FIG. 1, both legs 18, 20 are erected on the bottom 50 of the repository 14. Since both legs 18, 20 have different heights, the loading plate 16 is inclined. The loading plate 16 is maintained or bound by both wall surfaces 28 of the repository 14 between the wall surfaces 28, the loading plate 16 and both legs 18, 20 do not swing substantially relative to each other. As a result, the loading plate 16 is kept inclined above the bottom 50 of the repository 14. Consequently, the articles can be displayed on the loading plate to be readily seen and taken out.

The angle of inclination of the loading plate 16 or the height position can be changed by swinging one of both legs 18, 20 and changing the angle between the loading plate 16 and one of the legs 18, 20. By changing the angle of inclination of the loading plate 16 or the height position, a suitable display according to the quantity, sizes or the like of the articles can be realized.

Figure 3:
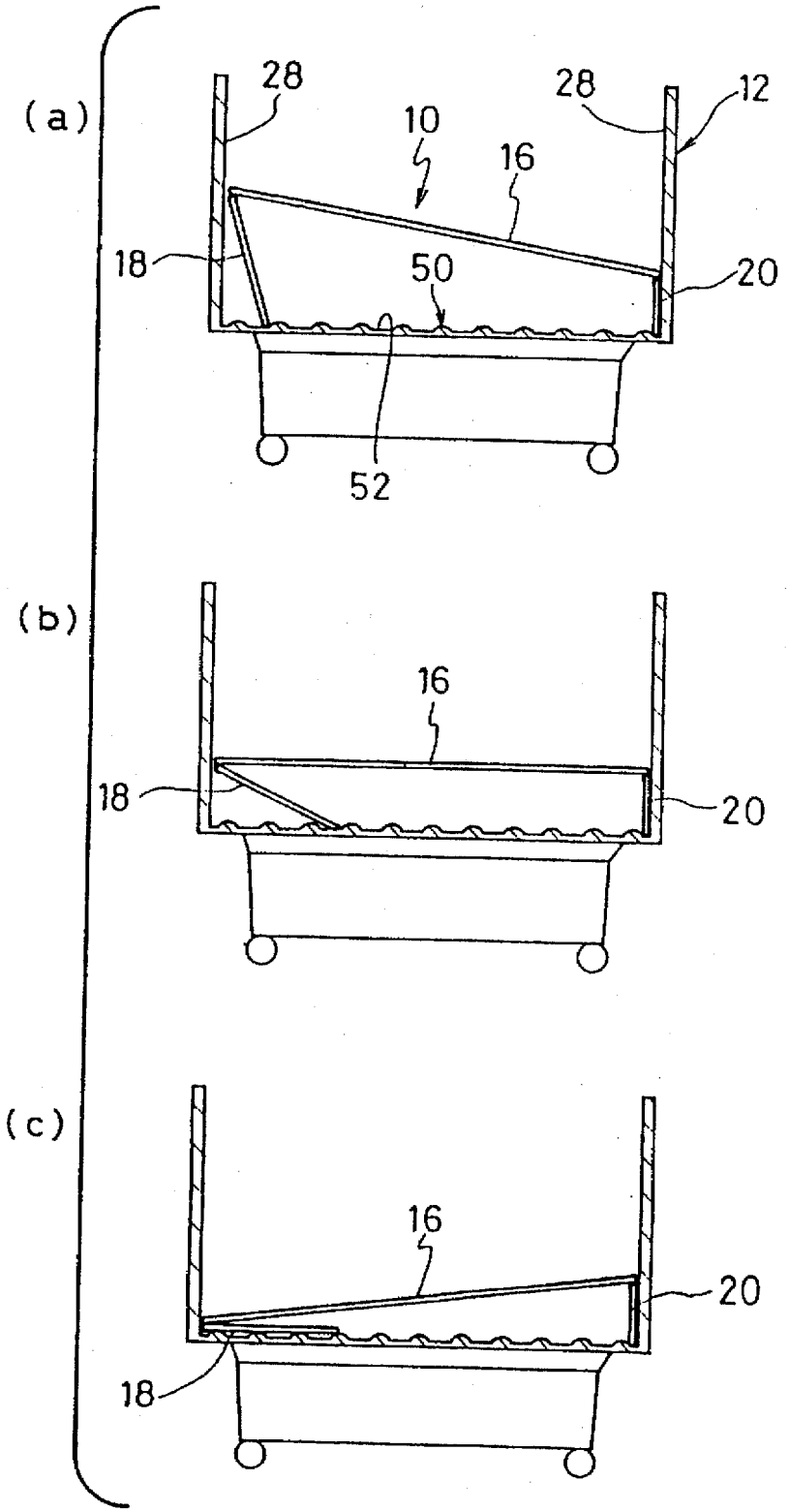
FIGS. 3 (*a*), (*b*) and (*c*) are respectively conceptual drawings of the display stand within the repository, with the legs having different angles of inclination.

For example, as shown in FIG. 3, by keeping the shorter leg 20 in its erected state and swinging and inclining the taller leg 18, the loading plate 16 can be less inclined (FIG. 3(*a*)), made approximately horizontal (FIG. 3(*b*)), or reversed in the direction of inclination (FIG. 3(*c*)).

Figure 4:
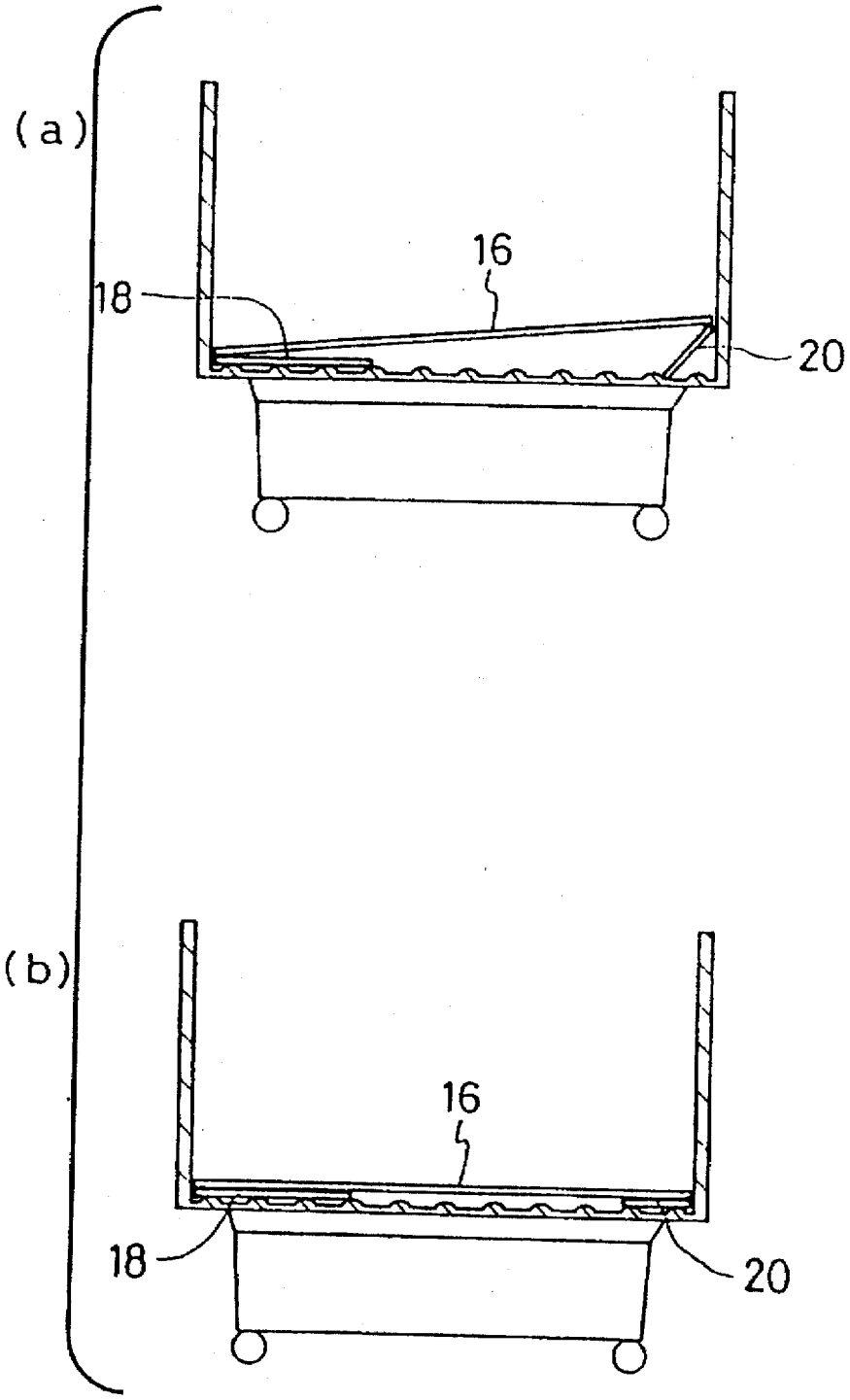
FIG. 4 (*a*) and (*b*) are conceptual drawings of the display stand inside the repository, respectively showing the states where one leg and both legs of the display stand are folded.

Also, for example, as shown in FIG. 4, by swinging and folding the taller leg 18 and swinging and inclining the shorter leg 20, the loading plate 16 inclined in the opposite direction can be less inclined (FIG. 4(*a*)), or both legs 18, 20 can be set in a folded state (FIG. 4 (*b*)) by swinging both legs 18, 20 together.

The bottom 50 of the repository 14 shown in FIG. 1 is provided with a plurality of grooves 52 disposed at intervals between both wall surfaces 28 and extending in parallel to both wall surfaces 28. Each groove 52 has a width dimension greater than either the diameter of one of the parallel portions 42, which is part of the second frame 34, or the diameter of one of the parallel portions 44 which is part of the second frame 36, or a length dimension greater than the length of one of the parallel portions 42, 44. Consequently, each groove 52 can receive one or both of parallel portions 42, 44 of each second frame.

One of the parallel portions 42 and 44 received in the one groove 52 stays therein and does not move between both wall surfaces 28. Consequently, the inclined state of the second frames 34, 36 inclined by swinging, namely, the angle of inclination of the loading plate as well as its height position, can be maintained.

Figure 5:
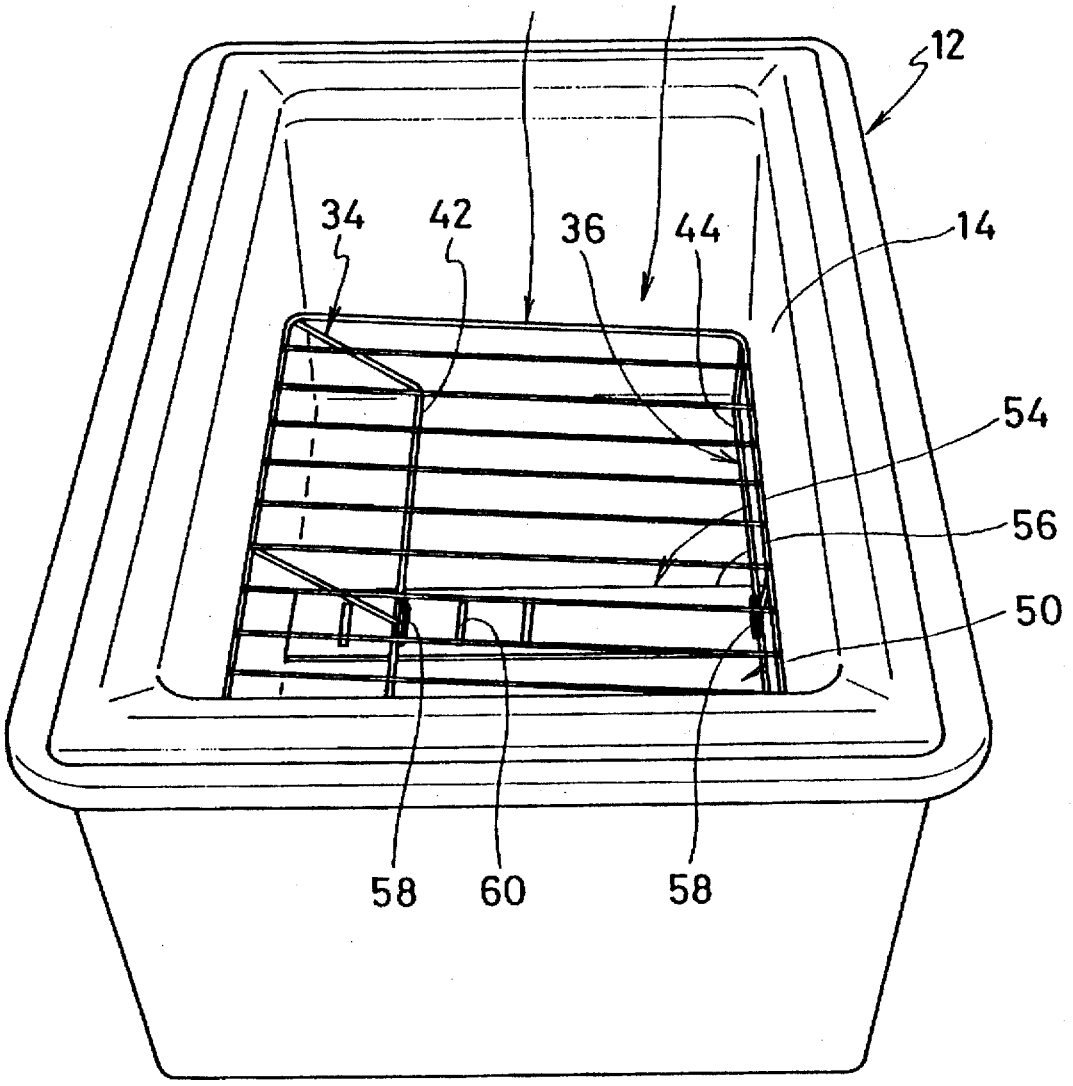
FIG. 5 is a perspective view of the display stand applied to the refrigerator show-case by using distance holding means.
Figure 6:
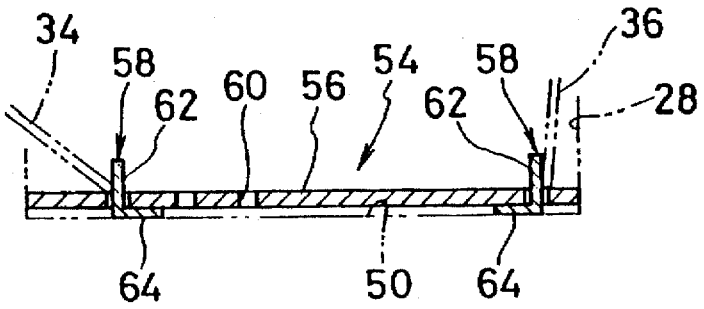
FIG. 6 is a vertical sectional view of the distance holding means.

If there are no grooves on the bottom portion of the repository 14, distance holding means 54 as shown in FIGS. 5 and 6 are used.

The distance holding means 54 comprises a plate member 56 having approximately the same length as the distance between both wall surfaces 28 of the repository 14 and extending between both wall surfaces 28 as well as a pair of pieces 58.

The plate member 56 has a plurality of holes 60 arranged at intervals in the direction of extension. Each piece 58 has an L-like cross sectional shape in the illustrated example, and one end portion 62 thereof is inserted from the lower surface of the plate member 56 toward its upper surface and into the hole 60 to be projected upward from the upper surface. Also, the other end portion 64 of the plate member 56 extends parallel to the lower surface of the plate member 56 to be in contact therewith. The other end portion 64 is brought into contact with the bottom 50 of the repository 14 when the distance holding means 54 is disposed inside the repository 14.

The display stand 10 is placed on the distance holding means 54 disposed on the bottom surface of the repository 14. At this time, the lower portion 42 of the second frame 34 and the lower portion 44 of the second frame 36 are respectively engaged with one end portions 62 of both pieces 58, thereby hindering both second frames 34, 36 from swinging to maintain the distance therebetween. As a result, the inclined state of both second frames 34,36, and accordingly, the angle of inclination of the loading plate 16 and its height position, can be maintained. The angle of inclination of both frames 34, 36 can be changed by selecting the holes 60 into which the pieces 58 are inserted.

The pieces 58 may be, for example, flat plate-like ones in place of the illustrated L-shaped ones. Also, for example, the holes 60 may be round ones, while the pieces 58 may be short round bars to be inserted into the holes. The holes may be, in place of the above-described one, holes which do not penetrate the plate member 56.

The distance holding means may be a spacer (not shown) in place of the illustrated example. The spacer consists of, for example, a plate member or a rod member which is disposed on the bottom of the repository 14 and between both second frames 34 and 36 and which has end faces abutted on the parallel lower portions 42, 44 of both frames. The spacer can keep the distance between both second frames 34 and 36. It is preferable to prepare a plurality of spacers with different lengths for changing the distance between both second frames.

What is claimed is:

1. In combination with an upwardly open refrigerator repository of rectangular cross-sectional shape with a bottom and with opposing side wall surfaces providing a given width dimension therebetween; a display stand in said repository comprising a loading plate having a width dimension approximately equal to said given width dimension of said repository; and a pair of legs having different height dimensions attached by pivotal attachment means to both edge portions defining the width dimension of said loading plate so as to be pivotally movable about axes parallel to both said edge portions; wherein a plurality of grooves are provided on said repository bottom at intervals, and wherein each said groove can receive part of each said left.

2. The combination according to claim 1, wherein said loading plate comprises of a rectangular first frame and a plurality of rod members disposed at intervals on the first frame, and wherein each said leg comprises a rectangular frame.

3. The combination according to claim 2, wherein each said leg frame is attached to said first frame through a plurality of sleeves which are attached to said first frame and through which part of each said leg frame extends.

4. In combination with an upwardly open refrigerator repository of rectangular cross-sectional shape with a bottom and with opposing side wall surfaces providing a given width dimension therebetween; a display stand in said repository comprising a loading plate having a width dimension approximately equal to said given width dimension of said repository; and a pair of legs having different height dimensions attached by pivotal attachment means to both edge portions defining the width dimension of said loading plate so as to be pivotally movable about axes parallel to both said edge portions; wherein a distance holding means for holding the distance between said legs is provided on said repository bottom; said distance: holding means includes a plate member extending between said opposing wall surfaces of said repository and having a plurality of holes arranged at intervals, and a pair of pieces inserted into a pair of said holes in said plate member and with which said legs can be engaged.

* * * * *